United States Patent [19]

Seelandt

[11] 4,332,552

[45] Jun. 1, 1982

[54] MOLDATHERM INSULATED PACEMAKER FURNACE AND METHOD OF MANUFACTURE

[75] Inventor: Karl H. Seelandt, Spring Grove, Ill.

[73] Assignee: General Signal Corporation, Stamford, Conn.

[21] Appl. No.: 193,609

[22] Filed: Oct. 3, 1980

[51] Int. Cl.[3] ..... F27B 5/14; F27D 1/00; F23M 5/00

[52] U.S. Cl. ..... 432/209; 110/336; 432/247

[58] Field of Search ..... 432/2, 209, 247; 110/336; 126/91 A

[56] References Cited

U.S. PATENT DOCUMENTS

| | | | |
|---|---|---|---|
| 1,551,180 | 8/1925 | Thornhill | 126/91 A |
| 3,363,889 | 1/1968 | Shirley et al. | 432/247 |
| 3,517,916 | 6/1970 | Ross et al. | 432/209 |
| 3,990,203 | 11/1976 | Greaves | 110/336 |
| 4,059,398 | 11/1977 | Zimmer et al. | 432/247 |
| 4,093,816 | 6/1978 | Case | 126/91 A |
| 4,209,295 | 6/1980 | Frahme et al. | 110/336 |
| 4,244,686 | 1/1981 | Scott, Jr. | 110/336 |
| 4,246,852 | 1/1981 | Werych | 110/336 |

FOREIGN PATENT DOCUMENTS

| | | | |
|---|---|---|---|
| 656896 | 9/1951 | United Kingdom | 432/209 |

*Primary Examiner*—John J. Camby

*Attorney, Agent, or Firm*—Oblon, Fisher, Spivak, McClelland & Maier

[57] ABSTRACT

An insulated furnace, method of manufacture and purging operation which includes a plurality of interconnected modular panels of fibrous material forming a furnace chamber, a heat source for the furnace chamber and a furnace shell surrounding the fibrous material panels so as to form a space between the shell and the fibrous material panels and to provide a thermal break of greater than 10° F. such that the furnace can be rapidly heated and water vapor and air can be rapidly purged from the furnace. An insulation panel is formed of at least one block of fibrous material in a molded form which includes mixed fibers and a frame member to which the at least one block of material is secured.

10 Claims, 7 Drawing Figures

MOLDATHERM INSULATED PACEMAKER FURNACE AND METHOD OF MANUFACTURE

BACKGROUND OF THE INVENTION

1. Field of the Invention

The present invention is directed to improved insulation panels for furnaces and to the corresponding method of forming such insulation panels. The present invention includes an insulated furnace assembly which utilizes the concept of a plurality of interconnected modular panels of fibrous material which serve to form and insulate a furnace chamber and to provide a thermal break of 10° to 30° F. between an outside surface portion of the insulation panel and the shell of the furnace. A method of removing residual air and water vapor from the furnace for subsequent operation is also utilized in the present invention.

2. Description of the Prior Art

Conventional refractory furnaces for the processing of steel, etc. usually use brick as an insulating material. Brick insulation has been found, however, to have a number of drawbacks including the fact that its use makes it impossible to quickly start up the furnace. Since initial start-up time is generally on the order of two weeks with brick insulation, it is necessary to gradually raise the heat within the furnace to remove residual gases in the form of air and water vapor. In other words, rapidly attempting to heat up and purge a conventional furnace may result in exceeding the exterior brick wall temperature standards established by the Occupational Safety and Health Administration and destruction of the brick insulation and the steel structure of the furnace itself which results in greater furnace down-time in repairing the brick structure. The problem with purging brick insulation is that the internal structure of brick is such that pockets of air formed therein are cellular in nature and not interconnected and it is therefore difficult to purge air and water vapor from the bricks themselves. More particularly, heating of the brick walled furnace interior can effectively remove only the air and water vapor collecting in pockets, formed in the brick when the brick itself was made, positioned on the interior surface of the brick or immediately adjacent thereto. Attempts to more effectively purge the brick furnace of air and water vapor by increasing the heat has merely resulted in a high incidence of structural failure of the brick itself and, for this reason, companies which operate such furnaces must then resort to employing a large number of highly skilled and relatively expensive brick layers to reconstruct the brick wall of the furnace. Even more importantly, structural failure of the brick results in a shut-down of the furnace for extended periods of time to allow for repair or complete reconstruction of the brick walls.

The process of initially purging a brick walled furnace also typically requires the use of purging gas to drive the water vapor and air out of the exhaust flue, a large percentage being first driven to the exterior or cold wall portion of the furnace and this required as much as six complete atmospheric changes per hour to effectively remove the air and moisture. The number of atmospheric changes required thus significantly contributed to the requirements of an approximately two week time period for purging of a new brick walled furnace.

Insofar as the drawback of using brick as insulation in a protective atmosphere furnace is that it is difficult to start up the furnace, such furnaces are usually continuously run even during the time periods within which steel is not being processed therein. To do otherwise would allow air and water vapor to again collect in the pockets formed in the brick and thus necessitate a renewed purging of the furnace in the manner described hereinabove. Accordingly, the cost of operating such conventional furnaces is quite high based upon the continuous use of energy even when steel is not being processed.

Another drawback of conventional brick insulation furnace is the fact that upon attempting to purge the furnace, water vapor tends to migrate away from the heat source within the furnace and towards the exterior wall of the brick insulation.

SUMMARY OF THE INVENTION

Therefore, one object of the present invention is to provide modular fibrous panels which can be easily inserted into any furnace to form interconnected walls of insulation material so as to be easy to assemble and replace.

Another object of the present invention is to provide modular fibrous material insulation panels which are formed with interconnecting air pockets so as to allow for rapid purging of water vapor and air during start up of the furnace and to significantly reduce the number of purge atmosphere changes required for purging the furnace.

A further object of the present invention is to provide a furnace which has a thermal break of 10° to 30° F. between the exterior portion of the insulation panel and the shell of the furnace which results in a colder furnace shell than could previously be obtained so as to be acceptable to the Occupational Safety and Health Administration. Also the exterior wall of the insulation panel can be allowed to be hotter than conventionally obtainable so as to enable more rapid purging of the furnace for carburizing or other processing type atmospheres when initially starting up the furnace or after shutdown to room temperature.

An additional object of the present invention is to provide a rapid purge of air as well as water vapor from the interior of the furnace and its insulation by allowing purging gas to be introduced between the exterior surface of the insulation and the shell of the furnace.

The foregoing objects of the present invention have been met by utilization of a furnace insulation panel including at least one block of fibrous material in a molded form wherein the material may include an alumina and silica fiber composite and additionally include a frame member insertable within the shell of the furnace to which the material is secured.

The insulated furnace assembly of the present invention includes a plurality of interconnected modular panels of fibrous material forming a furnace chamber, a source of heat for the furnace chamber and a furnace shell surrounding the fibrous material panels so as to form a space between the shell and fibrous material panel and to provide a thermal break of 10° to 30° F. such that the furnace can be rapidly heated and water vapor and air can be rapidly purged from the furnace.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
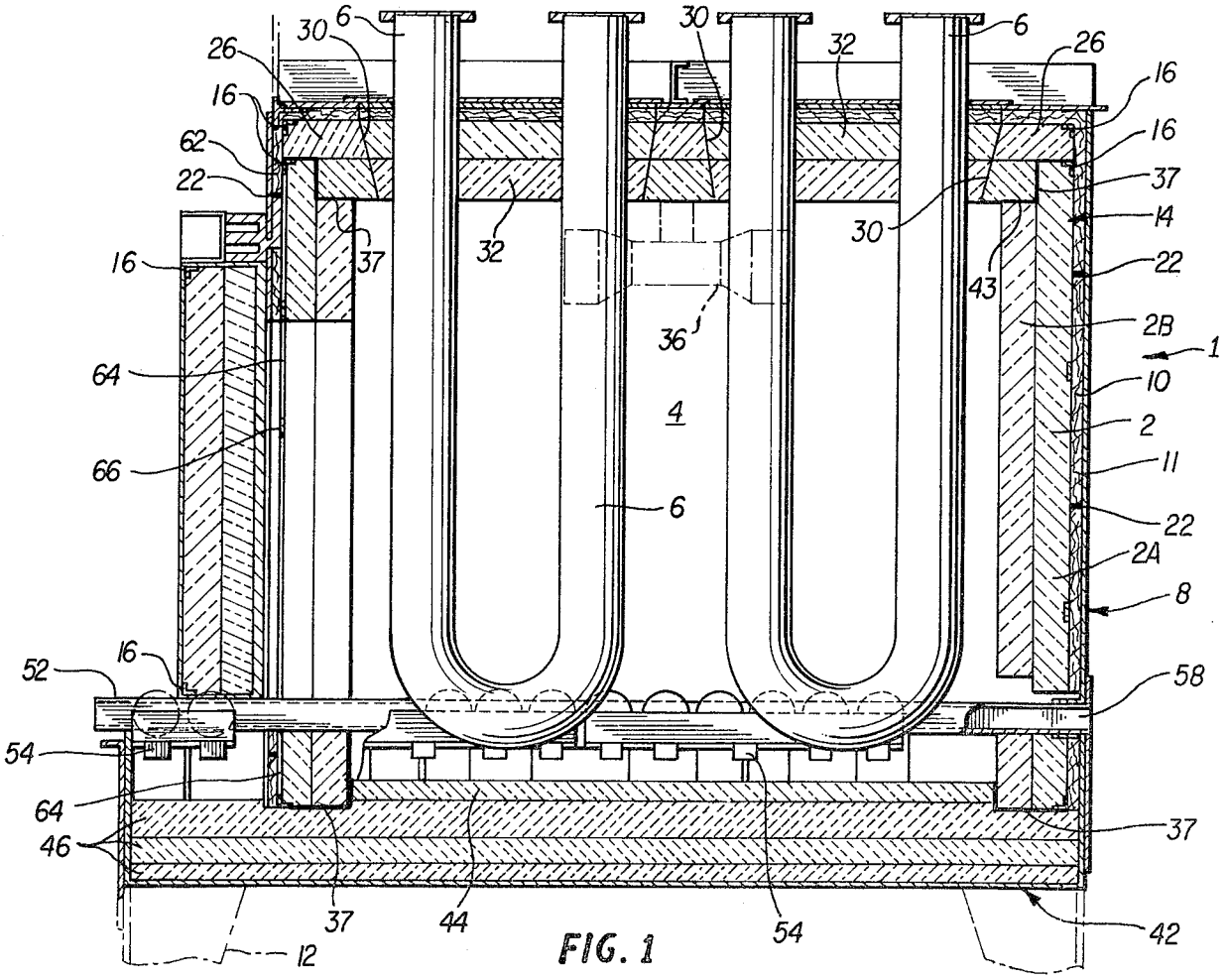
FIG. 1 is a cross sectional view of the insulated furnace assembly of the present invention.
Figure 2:
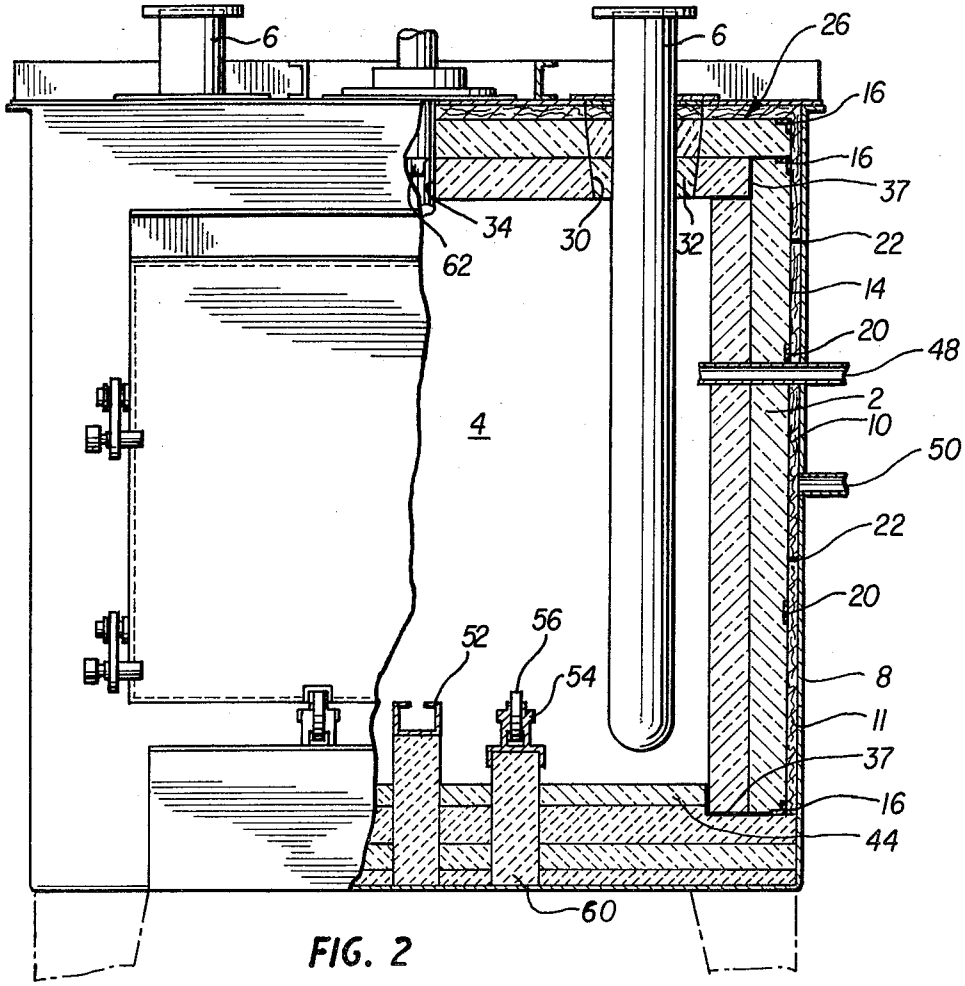
FIG. 2 is a partial cross sectional view taken along line II—II in FIG. 1.
Figure 3:
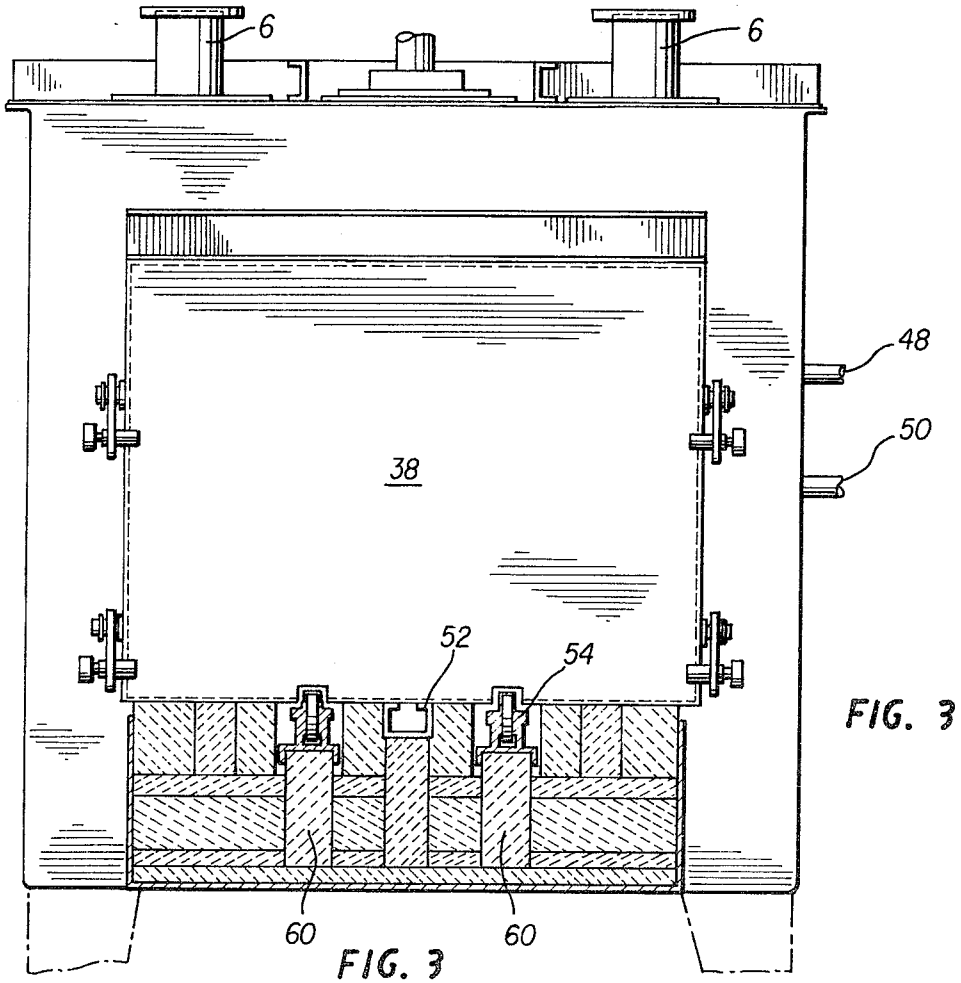
FIG. 3 is a partial cross sectional view taken along line III—III of FIG. 1.

Referring now to the FIGS. 1 through 3, such serve to illustrate a furnace assembly 1 which includes a plurality of panels 2 of fibrous materials and may each include both an exterior panel 2A and an interior panel 2B. The panels 2 serve to enclose the furnace chamber 4 into which is inserted at least one U-shaped heating tube 6. As an alternate to heating tube 6, a plurality of electric heating elements may be hung from the panels. The panels 2 are fitted within a steel or other type of furnace shell 8 so as to form a space 10 therebetween on the order of one inch although the exact dimensioning will depend on the type of furnace and its corresponding dimensioning. Space 10 may either be left unfilled or may have inserted therewith a blanket 11 of fibrous material which is receptive to the passage of gas therethrough.

Furnace assembly 1 includes a plurality of legs 12 for supporting the same from the floor. The furnace assembly 1 also includes side and rear walls assemblies 14 which may be of slightly different construction but which serve to surround and define furnace chamber 4.

Figure 5:
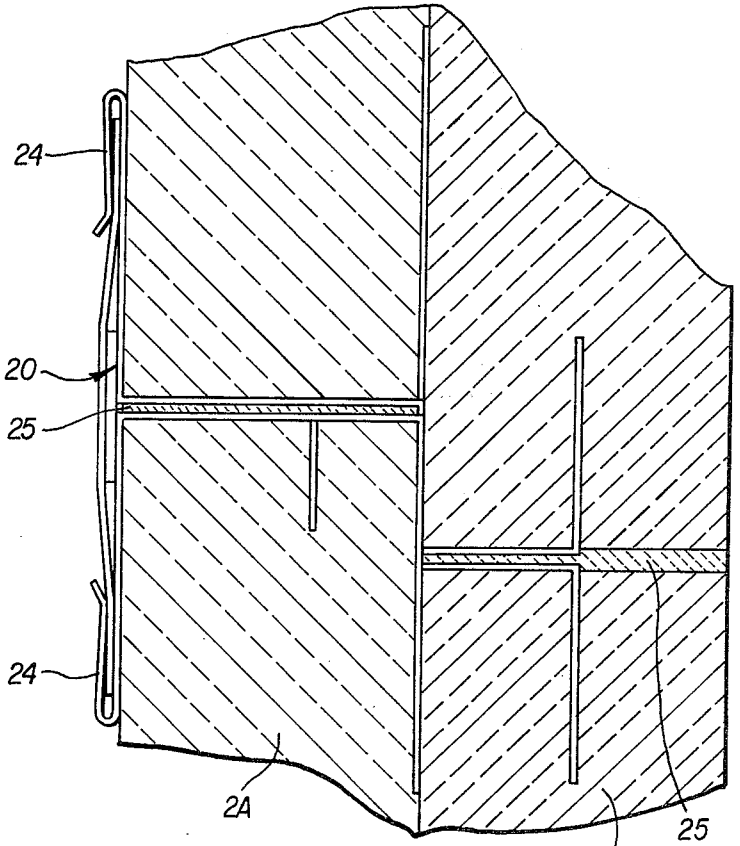
FIG. 5 is a detailed view of the manner in which insulation panels are secured to the frames.
Figure 4:
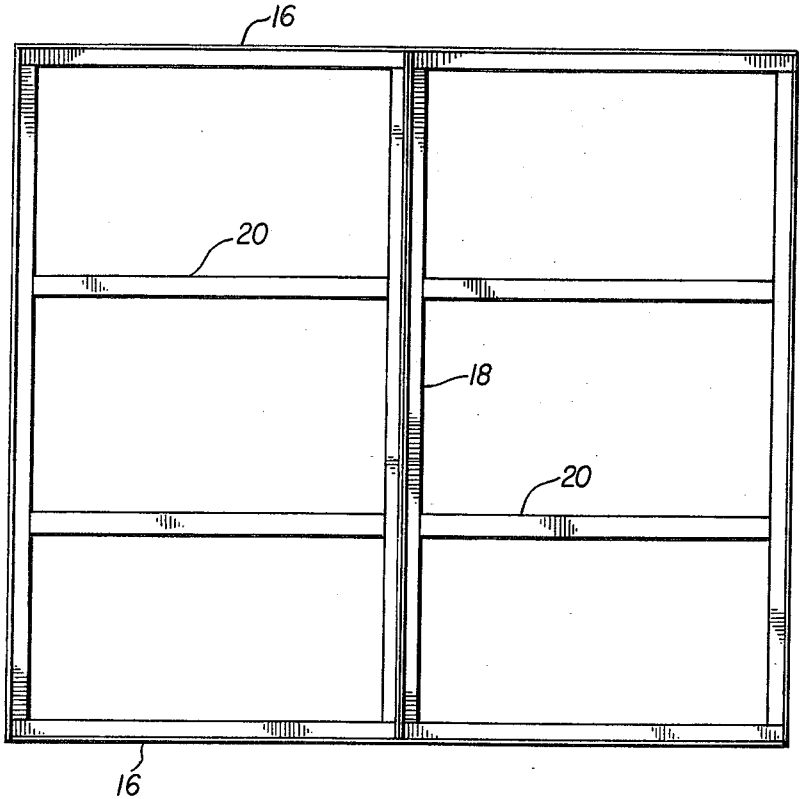
FIG. 4 is an elevational view of the frame for the insulation panel used for the side wall assembly.

FIG. 4 serves to illustrate an example of the structural elements utilized in forming the side wall assembly with it being understood that both the side and rear walls and other portions of the furnace assembly can be constructed in a somewhat similar manner. The wall assembly shown in FIG. 4 includes a rectangularly shaped outer frame 16, a center bar 18 and a plurality of cross bars 20 which interconnect center bar 18 with frame 16. Wall assembly 14 is constructed by securing blocks of fibrous material, to be discussed hereinbelow, to the center bar 18 and cross bars 20 by use of clips, retainers, bolts or other conventional securing members 24 as best shown in FIG. 5 so as to support at least an exterior panel 2A and, under some circumstances, an interior panel 2B with a blanket of insulating material 25 being inserted between adjacent panels. Moreover, spacers 22 in the form of bolts and threaded rods can be used to either secure the panels 2 to the furnace shell 8 or to assure that proper spacing to form space 10 is provided. Furnace shell 8 also includes an outwardly extending flange 28 for cooperation with roof assembly 26 which also includes a frame 16 similar to the wall assemblies for securing the exterior panel 2A and the interior panel 2B of fibrous materials. Roof assembly 26 includes a plurality of tapered openings 30 for cooperation with tube plugs 32 within which the U-shaped heating tubes are mounted.

Reference numeral 34 serves to denote an opening in roof assembly 26 for mounting of a gas circulation fan 36. Seal members 37 serve to effectively provide an optically-tight seal between interfacing edge portions 43 of adjacent wall assemblies the roof assembly, etc. so as to avoid leakage of purging gases introduced into the furnace into space 10. This seal is optically tight to radiant heat and substantially tight to circulating gas (i.e. it is still porous to gas penetrations in the molded fiber panel).

Figure 7:
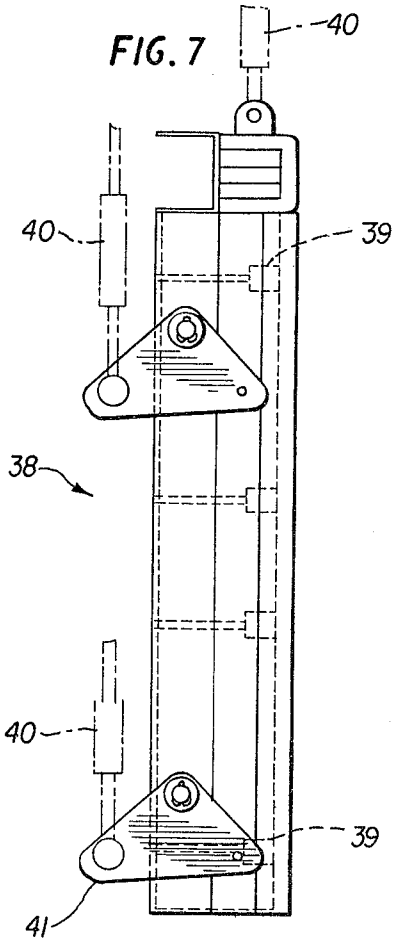
FIG. 7 is a side view of the door assembly and lift assembly for the door of the furnace.

Door assembly 38 includes a plurality of pins attached thereto for cooperating with the furnace assembly, as best shown in FIG. 7. Reference numeral 40 designates a lift assembly for the door assembly 38 with reference numeral 41 designating a crank member which serves to cooperate with the lift assembly 40 for retraction of pins 39 from cooperation with the furnace assembly and to allow for subsequent lifting of door assembly 38 by a conventional lifting mechanism.

Furnace assembly 1 includes a floor assembly 42 which constitutes a floor panel 44 of fibrous material mounted on a plurality of layers of brick insulation 46. Reference numeral 48 designates a first source of purging gas (i.e. nitrogen most commonly used but other types of inert gasses are acceptable) which may be supplied to furnace chamber 4 while reference numeral 50 denotes a second source of purging gas which can be supplied to space 10 formed between the panels of fibrous materials and the furnace shell 8.

Floor assembly 42 also includes a furnace snake chain guide assembly 52 used for transfer of steel or other products into furnace chamber 4. Roller rails 54 are also provided so as to assist in transfering the work product into furnace chamber 4 with cast rollers 56 being mounted on roller rails 54. Furnace chamber 4 also includes a chain guide opening 58. Floor assembly 42 is provided with a rail support 60 upon which roller rails 54 are mounted.

Figure 6:
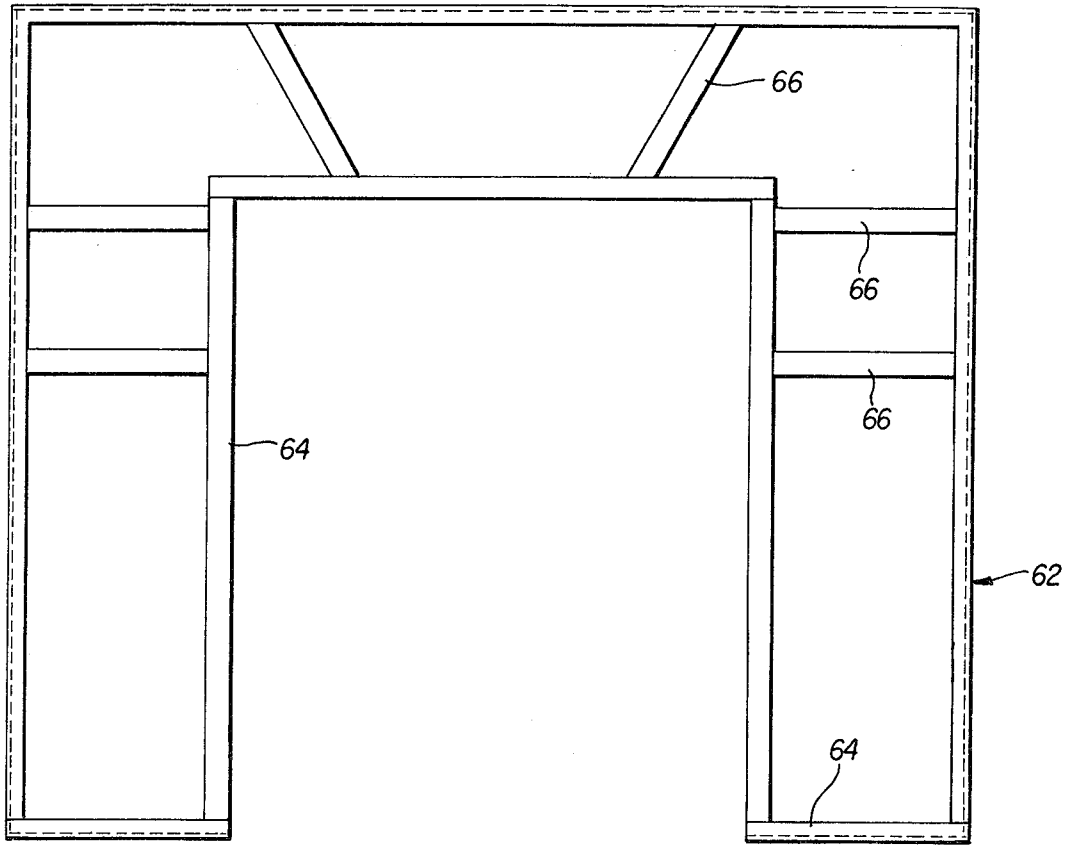
FIG. 6 is an elevational view of the frame of the vestibule assembly.

Reference numeral 62 designates a vestibule assembly, as best shown in FIG. 6, which includes a frame 64 and a plurality of interconnecting support members 66 for mounting of panels 2A and 2B in a manner similar to that of the side and rear walls.

The furnace assembly 1 thus serves to provide a furnace chamber 4 which, during purging operation, is heated by the U-shaped heating tubes to a temperature between 500° and 2000° F. such that purging gas is introduced from the first source 48 which may include any inert gas and purging gas which forms an enriched endothermic atmosphere within the furnace chamber is circulated by operation of gas circulating fan 36. The protective atmosphere within furnace chamber 4 is also subjected to a pressure which is approximately 0.2 ounces above atmospheric pressure. A corresponding auxiliary gas purge can also be accomplished by the introduction of nitrogen or a similar type gas under pressure approximately 0.2 ounces or more above atmospheric pressure within space 10 via the second source 50 of purging gas. Due to the composition of the panels of fibrous materials, the nitrogen gas under pressure serves to assist purging of the furnace itself by keeping the exterior surface of exterior panel 2A at a higher temperature than is possible in a conventional furnace and purges water vapor and air by forcing the same towards the furnace chamber by such application of heat. Thus the back wall of exterior panel 2A can be kept at a temperature above the boiling point of water such that the space 10 provides a thermal break of 10° to 30° F. between the exterior surface of exterior panel 2A and furnace shell 8. This enables the furnace to be more rapidly purged for carburizing or other processing gas atmospheres when initially starting up the furnace or after a shutdown to room temperature. The processing gases may be active (i.e., with $H_2$, CO or $CH_4$ etc.), neutral, (i.e., substantially inert but still containing some $H_2$ or CO) or in some cases may also be an inert gas. Furthermore, space 10 allows for a faster purge of air and water vapor from the interior of the furnace and its insulation by exposing the exterior surface of panel 2A to the auxiliary purging gas so as to drive the water vapor and air which has migrated towards the exterior surface of exterior panel 2A back to the interior portion of the furnace chamber in order to efficiently and substantially completely purge the panels of fibrous materials of air and water vapor. It should be noted that the range of thermal break is contemplated as being higher than 10° and may even be as much as 250° depending upon the width of the panels of insulation. The present invention allows a cutting back of the number of purge atmosphere changes necessary by a two-third's margin versus a conventional brick walled furnace.

The insulation panel of fibrous materials is related to the electrical heating unit with an insulating refractory support disclosed in U.S. Pat. No. 3,500,444 to Hesse et al. Such patent discloses a composite, thermally insulated electrical heating unit including an electrical heating element substantially embedded and secured within an insulating body of filter molded inorganic refractor fiber.

In accordance with the present invention a composite, highly effective insulated unit, adaptable to a variety of applications as set forth hereinabove, includes a thermal insulating body in the form of a block of panel of optimum effectiveness at temperatures and conditions normally encountered with such unit and a method of achieving the same. The invention enables the utilization of highly effective insulating materials of low density, flexible and resilient integrated masses of inorganic refractory fiber by forming a body of insulating material into an integrated mass of fibers. The formation of the fibrous insulating body by means of filter molding causes the individual fibers during filtration to uniformly intertwine and knit themselves.

The insulation molding operation of this invention includes the use of a suitable filter molding screen or filter and, although the screen or filter element mold may be oversized such that a larger insulating body than required is formed and thereafter cut to size, it is economically advantageous that the mold screen be designed as to size and configuration to precisely mold the insulating body which is to form insulation panels.

The filter molding slurry utilized in the present invention includes refractory fiber and any other desired ingredients such as a binder, filters, filter aids, etc. disbursed within a liquid medium in proportions to provide a relatively dilute suspension as, for example, approximately 0.1 to 10% by weight of total solids and preferably 1% by weight of total solids. The filtering operation can be carried out with a vacuum mold apparatus with the filtering action of forcing the liquid phase of the suspension of solids through the mold screen being induced by a pressure differential provided either by the application of subatmospheric pressures downstream of the filter or the application of super atmospheric pressure upstream through any spot means including a hydraulic head or the application of pneumatic, hydraulic or mechanical piston means, and including open or closed filter chambers. A subatmospheric or vacuum activated filtering operation is preferred with the pressure being induced by a pump because of the relatively simple equipment requirements and its corresponding flexibility.

The filtering operation of forcing the liquid component of the suspension through the filter mold or screen so as to thereby retain and accumulate or collect the fiber and any other entrained solids on the screen, forming the body of the insulation is simply continued until the insulating body has built up to the required or desired thickness. Densities of the resulting filter molded fibrous insulating bodies for maximum insulating efficiency and ample strength should range from about 4 to 30 lbs. per cubic foot and preferably about 10 to 15 lbs. per cubic foot for an optimum balance of insulating efficiency and strength. Product densities can be achieved or controlled by variation of the kind of fiber, degree of pressure applied, composition of the slurry, etc.

Suitable inorganic refractory fibrous material for the insulating body of this invention includes those known manufactured fibrous products which are temperature resistant and are of a composition to effectively resist thermal deterioration at the contemplated or designed temperature levels of use and further provide a reasonable safety margin over maximum operating temperatures. Fibrous materials include semi-refractory wools or mineral fibers formed of relatively pure rock or argillaceous matter, or metallurgical slags which normally provide, depending upon composition or purity thereof, thermal resistance up to about 1200° to 1500° F., but preferably high refractory compositions such as silica or quartz, magnesia, alumina-silica compositions including those alumina-silica compositions containing titania and/or zirconia in wide ranges of proportions as that in the art, etc., and assorted combinations of such synthetically produced inorganic fibers which exhibit resistance to deterioration at temperatures up to in the order of 2000° to 2500° F. Such heat resistant synthetic fibers and compositions therefor are more fully discussed in an article entitled "Critical Evaluation of the Inorganic Fibers" in Product Engineering, Aug. 3, 1964, pages 96 to 100. The relatively stiff but resilient characteristic typical of these synthetically produced inorganic fibers provides, upon forming by filter molding, the type of insulation block designed for forming insulation panels.

Preferably, the inorganic fibrous insulating block includes a binder disbursed throughout the fibers to enhance the adherence of the fibers to each other and in turn the integrity and strength of the resultant insulating body. High temperature binders which may be include, for example, clays such as bentonite or hectorite, alkali metal silicates such as sodium and potassium silicates, frit, borax, aluminum phosphate, colloidal silica, colloidal alumina, etc. and combinations thereof in finely divided particulate, liquid suspension or solution form. Suitable proportions of refractory fiber to inorganic binder include approximately 60 to 100 parts by weight of fiber to approximately 0 to 35 parts by weight of binder with a typical optimum of about 75 to 90 parts by weight of fiber per 25 to 10 parts by weight of binder. Binder may be applied either by disbursing the same in the stock suspension of fiber in the liquid and collected upon the fiber during the filter molding operation, and- /or by means of a subsequent application or impregnation of the formed insulating body if inorganic refractory fiber is utilized.

In addition to the inorganic refractory fiber and inorganic fibers, small proportions of various other additives or components may be included to improve or augment the manufacturing process or contribute specific properties. For example, organic or fugitive binders which burn out such a common starch based binder materials and synthetic or natural resins may be appropriate to contribute green or a pre-dried strength to facilitate handling or other manufacturing operations. Also, small proportions of non-refractory fibrous materials such as cellulosic fibers as exemplified by news or kraft pulp also may be effective in enhancing filtering or contributing to pre-dried strength or coherence in the green or unifired product.

Additional means of protecting the surface of the block of inorganic refractory fiber, and/or increasing its strength and resistance to abuse, includes impregnating or treating the surface or entire body with an appropriate indurating agent such as sodium silicate, colloidal silica, colloidal alumina, alumina phosphate, zirconium pyrophosphate, etc.

As a specific example of the method of forming blocks in accordance with the present invention, a plurality of relatively long alumina and silica fibers are first obtained although it is contemplated that any type of fibers which act as effective light weight and insulative material can be utilized. These fibers are mixed together and placed in a tank filled with water or other liquid medium to form a slurry. A vacuum type mold or similar mold having an outer frame, screened bottom and top plate is then immersed into the slurry. Suction is then applied to the mold so as to pull solution through the screen so as to remove excess fluid and to retain a concentration of moistened mixed alumina and silica fibers within the mold. The mold may then be raised above the tank and transported to a drying area for drying between 1 to 24 hours. In drying, the concentration of moistened mixed alumina and silica fibers shrink away from the walls of the mold and can be removed from the mold if desired so as to form a moldatherm block or piece. The moldatherm block or piece is then either placed in an oven and cured or, if a rigid surface portion is desired, can be brushed with a solution of $NaSiO_3$ (water glass) such that upon curing, a hardened surface is formed so as to avoid abrasion due to the circulation effect of the purging gas under the influence of gas circulation fan 36. The curing temperature depends upon the anticipated operation of the furnace such that, for example, if the furnace is to operate at 1800° F., the moldatherm block is cured at approximately 1800° F. Even so, the temperature range for curing the moldatherm block typically falls within the range of 500° to 2500° F.

Where the temperature range of operation of a furnace is expected to be above approximately 2500° F., it may be preferable to use zirconia fibers to substitute for either the alumina or silica fibers individually or to be used exclusively. This allows the insulation to remain effective despite the extremely high temperatures present within the furnace and, accordingly, the insulation which includes at least a portion of zirconia fibers would be cured at a temperature corresponding to the anticipated operation of the furnace itself.

Upon formation of the block of fibrous insulation, the same is secured to frame 16, cross bars 20, etc. by clips, retainers, bolts or other conventional occurring members 24 as best shown in FIG. 5 and, depending upon the size needed for the side wall assembly, rear wall assembly, etc. may include one or more layers of insulation blocks. It is also contemplated that the block of fibrous material be secured to the frame in situ during the molding if such is desired in expediting production of the furnace walls.

It can thus be appreciated that the present invention allows for a significant reduction in the overall cost of operating a furnace as compared with conventional brick walled furnaces. In particular, the present invention allows for purging of a furnace in a matter of minutes rather than days and more effectively purges the furnace of air and water vapor in connection with relatively few changes in purging atmosphere. The exterior wall temperature of the shell of the furnace can also be significantly less than that typified by conventional brick-walled furnaces so as to comply with the standards of the Occupational Safety and Health Administration. The present invention further allows for reducted cost of original construction, operation and reconstruction of the furnace and significantly reduces the risk of destruction of walls and supporting structure of the furnace during purging. In light of the fact that the present invention allows for discontinuous and selective operation of the furnace, a significant savings in energy is assured.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An insulated furnace assembly comprising:

a plurality of interconnected modular panels of fibrous material comprising alumina and slica fibers having interconnecting highly gas permeable air pockets formed therein, said panels exclusively forming a furnance chamber;

means for heating said furnace chamber to a temperature from 500° F. to 2000° F.;

means for rapidly purging said furnace of residual air and water vapor wherein said purging means further comprises a furnace shell surrounding said fibrous material panels so as to form a space between said shell and said fibrous material panels;

means for circulating a first gas within said furnace chamber;

means for circulating a second gas within said space formed between said shell and said fibrous material panels such that said furnace chamber and said space are rapidly purged of said air and water vapor;

means for forcing said air and water vapor through said fibrous material panels into said furnace chamber, wherein said forcing means further comprises means for pressurizing said first gas to a first pressure above atmospheric pressure and means for pressurizing said second gas to a second pressure equal to or greater than said first pressure such that any portion of said air and water vapor which has migrated from said furnace chamber toward said space is forced back toward said furnace chamber;

frame means upon which said fibrous material panels are mounted; and means for interconnecting said fibrous material panels.

2. An insulated furnace assembly as set forth in claim 1; said frame means comprising a rectangularly shaped outer frame, a center bar member and a plurality of cross bar members interconnecting said center bar with said outer frame.

3. An insulated furnace assembly as set forth in claim 1, said furnace comprising a protective atmosphere type furnace having an enriched endothermic atmosphere.

4. An insulated furnace assembly as set forth in claim 1, said means for heating said furnace comprising at least one U-shaped tube supported by said fibrous material panels and including a plurality of sealed burners.

5. An insulated furnace assembly as set forth in claim 1, said means for circulating said first gas comprising a fan member mounted to said fibrous material panels and positioned within said furnace chamber.

6. An insulated furnace assembly as set forth in claim 1, said means for heating said furnace comprising at least one U-shaped tube supported by said fibrous material panels and including a plurality of electric heating elements.

7. An insulated furnace assembly as set forth in claim 1 further comprising a blanket of material disposed within said space between said shell and said fibrous material panels.

8. An insulated furnace assembly as set forth in claim 1, wherein adjacent panels of said interconnecting panels include interfacing edge portions which cooperate to interconnect said adjacent panels.

9. An insulated furnace assembly as set forth in claim 8, further comprising:

means for optically-tightly sealing said interfacing edge portions which cooperate to interconnect said adjacent panels.

10. An insulated furnace assembly as set forth in claim 1, said frame means further comprising:

retainer means for interconnecting said first and second layer of fibrous material blocks to said frame.

* * * * *